US010010125B1

(12) United States Patent
Maman

(10) Patent No.: US 10,010,125 B1
(45) Date of Patent: Jul. 3, 2018

(54) HAIR EXTENSION DEVICES

(71) Applicant: Zip Loxx, LLC, Edgewood, NY (US)

(72) Inventor: Priel Maman, Ft. Lauderdale, FL (US)

(73) Assignee: Zip Loxx, LLC, Edgewood, NY (US)

( * ) Notice: Subject to any disclaimer, the term of this patent is extended or adjusted under 35 U.S.C. 154(b) by 0 days.

(21) Appl. No.: 15/692,644

(22) Filed: Aug. 31, 2017

Related U.S. Application Data

(60) Provisional application No. 62/482,000, filed on Apr. 5, 2017.

(51) Int. Cl.
*A41G 3/00* (2006.01)
*A41G 5/00* (2006.01)

(52) U.S. Cl.
CPC ..... *A41G 5/0073* (2013.01); *A41G 5/0046* (2013.01)

(58) Field of Classification Search
CPC ..... A41G 5/00; A41G 5/0013; A41G 5/002; A41G 5/026; A41G 5/004; A41G 5/0053; A41G 5/0046; A41G 5/0073
USPC ..... 63/43; 24/30.5 R, 298, DIG. 50, DIG. 51
See application file for complete search history.

(56) References Cited

U.S. PATENT DOCUMENTS 1,609,208 A 11/1926 Schneeberger et al.
3,363,293 A * 1/1968 Nemrod Henrys ..... B65D 33/1616 24/30.5 P
3,809,099 A 5/1974 Goldberg et al.
5,722,434 A 3/1998 Walker
5,813,418 A 9/1998 Pillars
5,937,867 A 8/1999 Williams et al.
6,019,107 A * 2/2000 Overmyer ..... A41G 5/004 132/201
6,634,366 B1 * 10/2003 Simmons ..... A41G 5/0073 132/278
7,168,432 B1 1/2007 Brumfield
7,201,171 B2 4/2007 Sthair
8,844,541 B2 * 9/2014 Guliker ..... A41G 5/008 132/201
8,905,046 B2 12/2014 Carvalho
9,241,525 B2 * 1/2016 Alex ..... A41G 5/008
2003/0075196 A1 4/2003 Fair
2003/0172948 A1 9/2003 Gabriele-Baumann
2005/0268932 A1 12/2005 Gold
2006/0005849 A1 1/2006 Thomas-Dupree
2006/0169296 A1 8/2006 Gill et al.
2007/0006890 A1 1/2007 Sthair
2008/0190442 A1 8/2008 Kwak
2008/0245384 A1 10/2008 Richman
(Continued)

FOREIGN PATENT DOCUMENTS

WO 2016075679 A1 5/2016

OTHER PUBLICATIONS

International Search Report for International Application No. PCT/US2017/49863, dated Nov. 21, 2017, 2 pages.

*Primary Examiner* — Rachel Steitz
(74) *Attorney, Agent, or Firm* — Barnes & Thornburg LLP

(57) ABSTRACT

A hair extension for integration with a person's head of hair is described in this disclosure. The hair extension illustratively includes a plurality of supplemental hairs and an attachment band that provides means for removably coupling the plurality of supplemental hairs to natural hairs included in the person's head of hair. The attachment band is illustratively flexible and couples to natural hairs included in the person's head of hair mechanically.

20 Claims, 9 Drawing Sheets

(56) References Cited

U.S. PATENT DOCUMENTS

| | | | | |
|---|---|---|---|---|
| 2011/0061674 | A1* | 3/2011 | Oeffinger | A41G 5/0073 132/275 |
| 2012/0125356 | A1 | 5/2012 | Alex | |
| 2015/0090289 | A1 | 4/2015 | Kaplan | |
| 2016/0135531 | A1 | 5/2016 | Ezechukwu | |
| 2017/0202290 | A1* | 7/2017 | Thomas | A41G 5/006 |

* cited by examiner

HAIR EXTENSION DEVICES

PRIORITY CLAIM

This application claims priority under 35 U.S.C. § 119(e) to U.S. Provisional Application Ser. No. 62/482,000, filed Apr. 5, 2017, which is expressly incorporated by reference herein.

BACKGROUND

Hair extensions are used to add length or fullness to a person's natural heads of hair for cosmetic reasons. These devices include supplemental hairs from another human head or from synthetic sources to augment natural hairs on a person's head. The supplemental hairs are integrated into a person's natural head of hair using one of a number of methods. However, many of these methods can be time consuming, costly, and/or damaging to a person's natural head of hair.

SUMMARY

A hair extension for integration with a person's head of hair is described in this disclosure. The hair extension includes a plurality of supplemental hairs and means for attaching the plurality of supplemental hairs to a person's head of natural hairs.

In illustrative embodiments, the hair extension includes an attachment band that provides means for removably coupling the plurality of supplemental hairs to natural hairs included in the person's head of hair. The attachment band is flexible and couples to natural hairs included in the person's head of hair mechanically in response to pressing and sliding a finger along the attachment band when a person's natural hair is received in the attachment band.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

Figure 9:
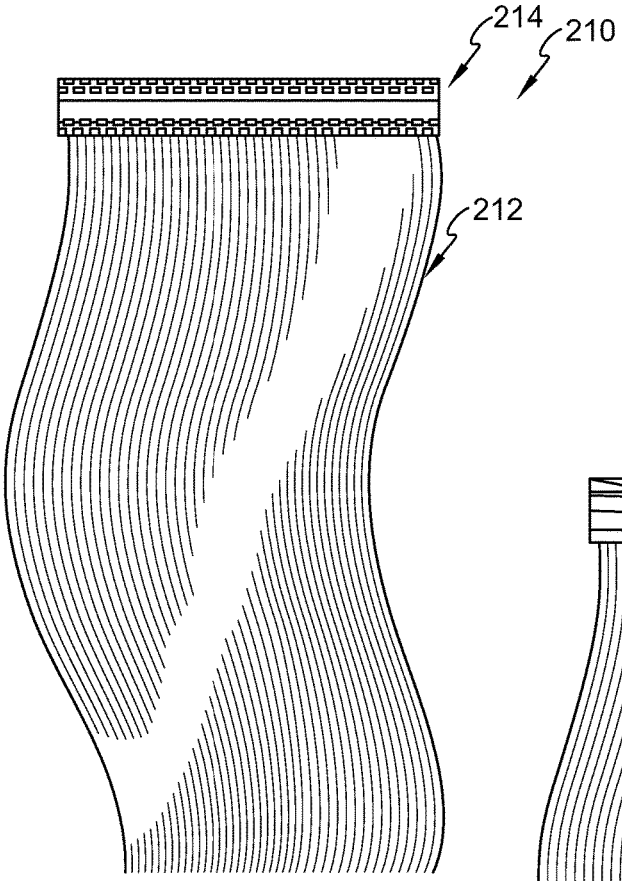
FIG. 9 is a front elevation view of a second hair extension that includes supplemental hairs and an attachment band for coupling the supplemental hairs to a person's natural head of hair and showing that supplemental hairs extend from a front side of the attachment band.
Figure 10:
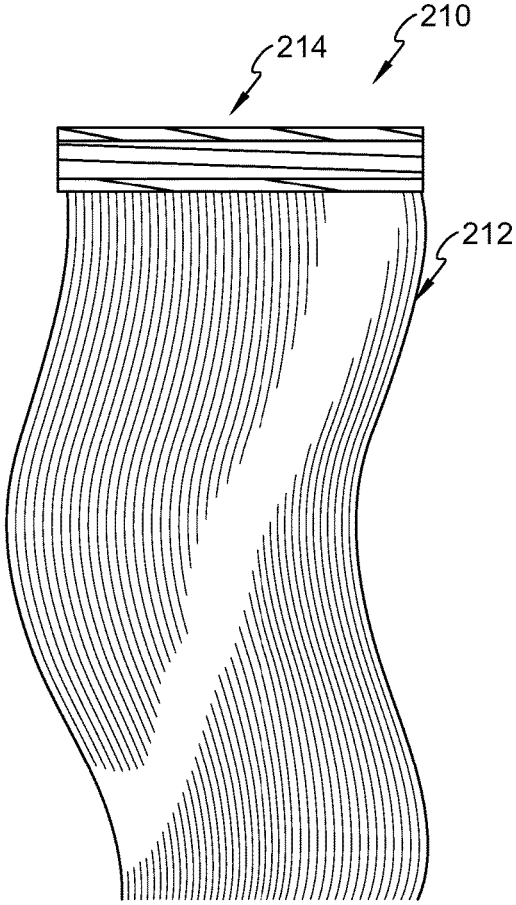
FIG. 10 is a rear elevation view of the hair extension of FIG. 9 showing that supplemental hairs also extend from a rear side of the attachment band.
Figure 11:
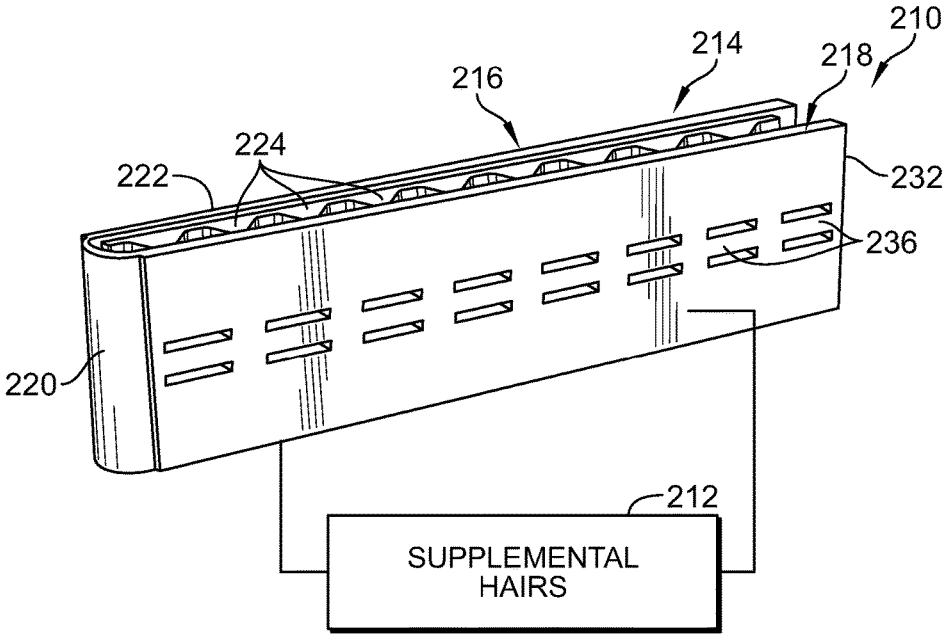
Figure 12:
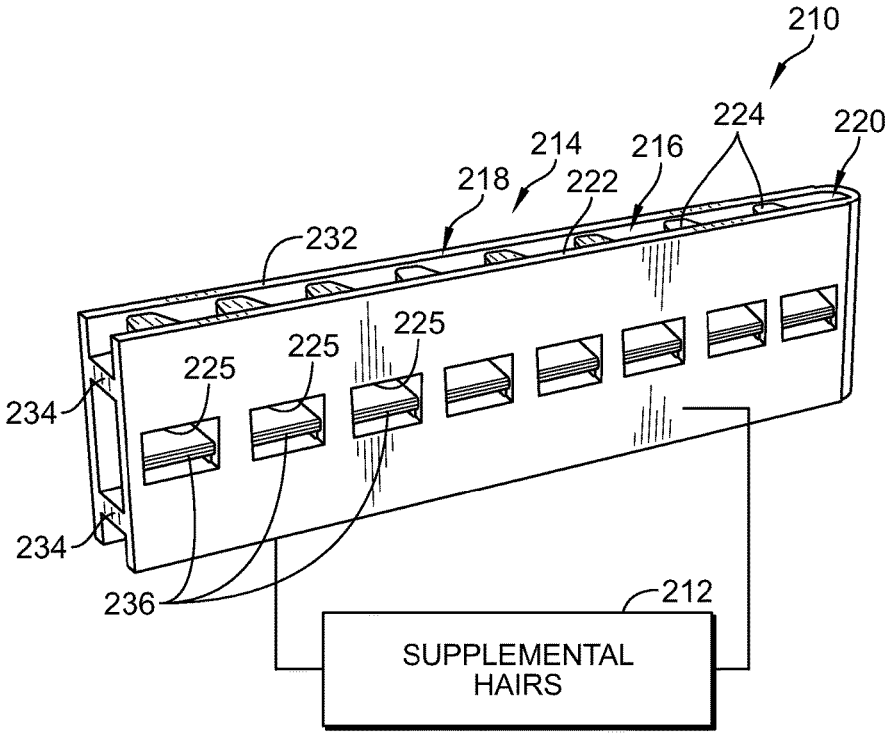
Figure 13:
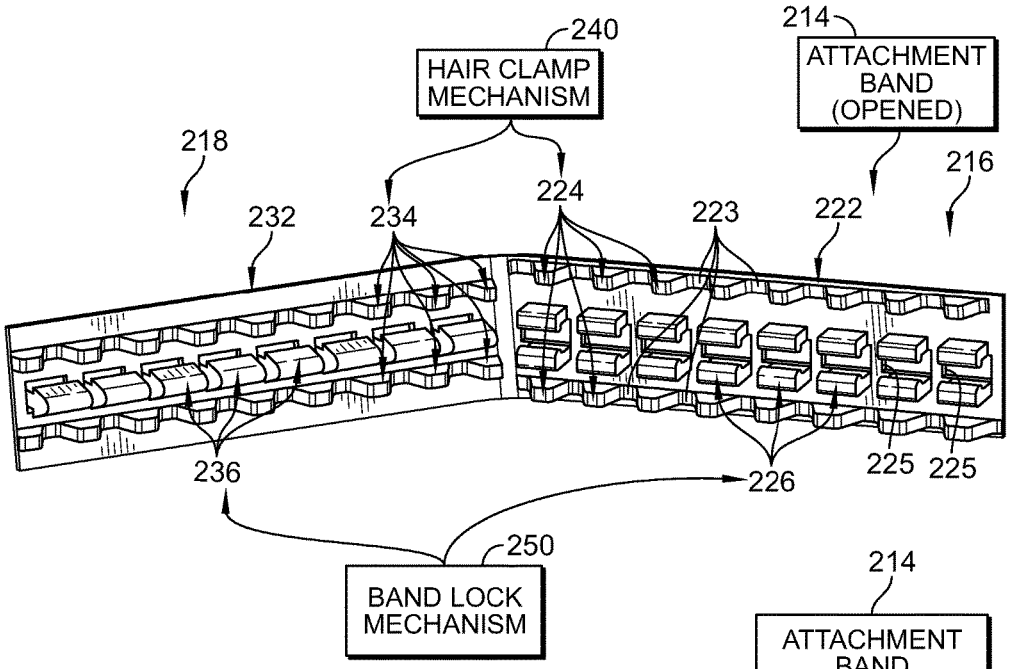
Figure 14:
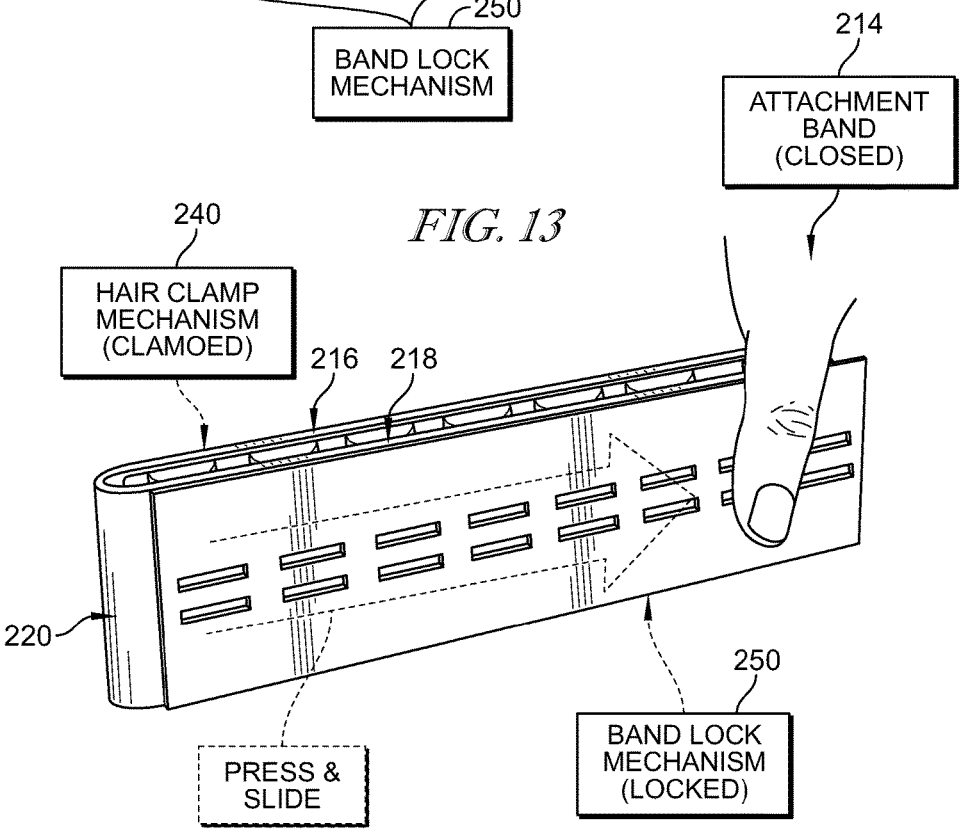
Figure 15:
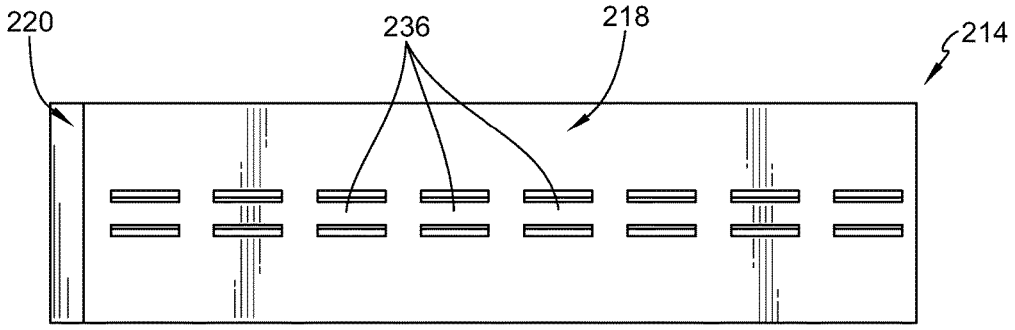
Figure 16:
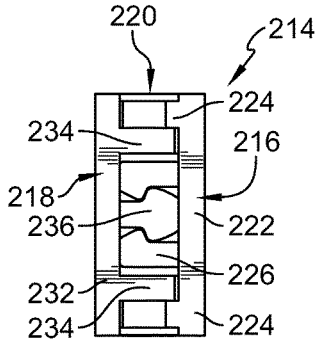
Figure 17:
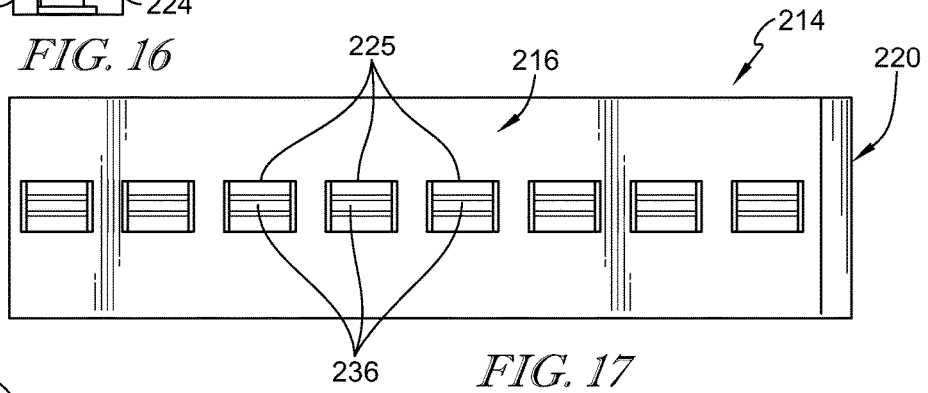
Figure 18:
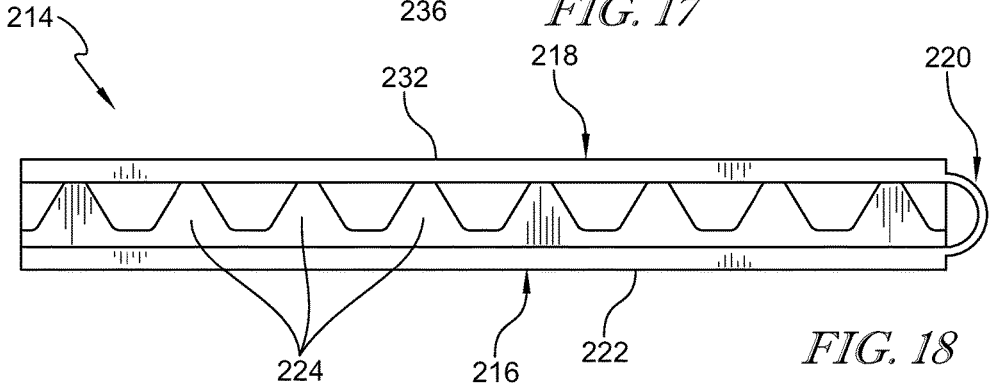
Figure 19:
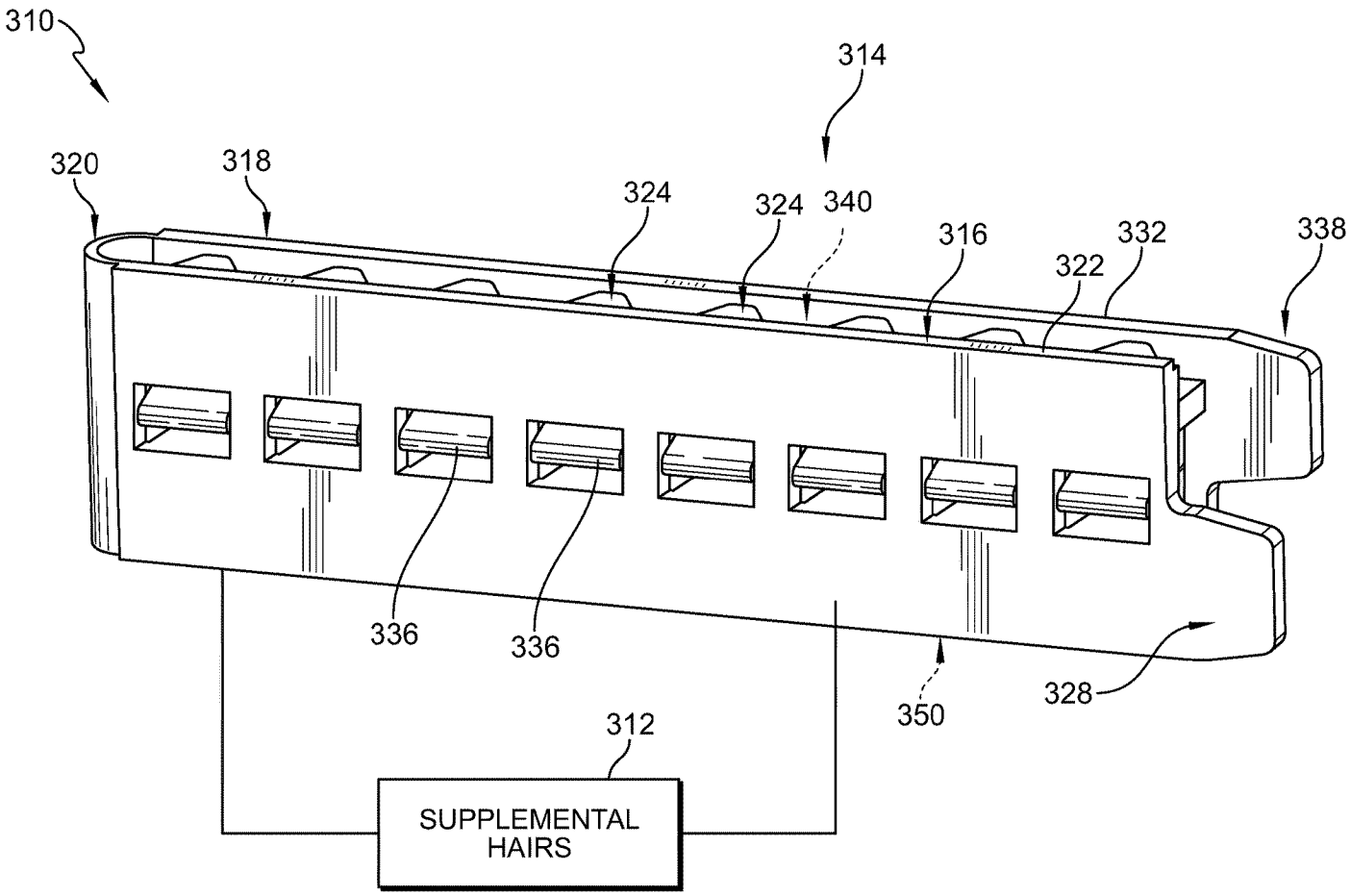
Figure 20:
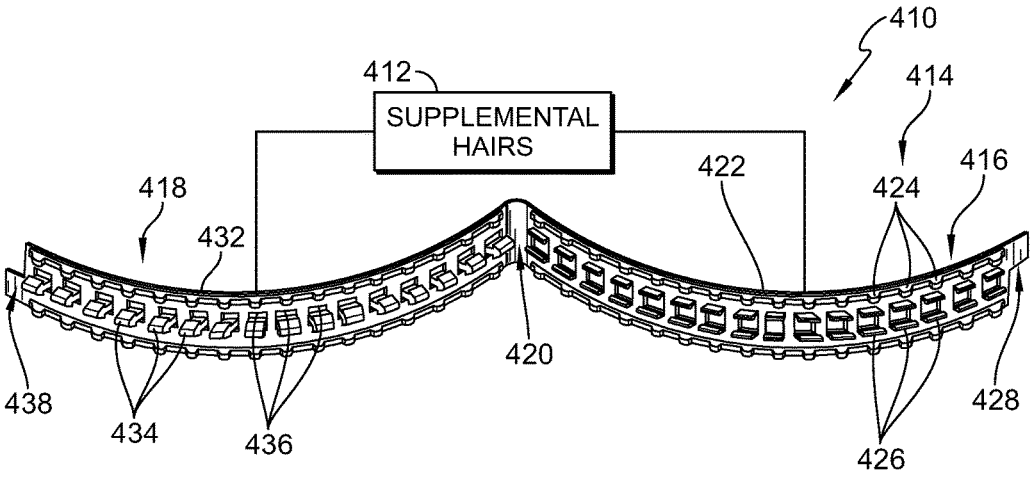
Figure 21:
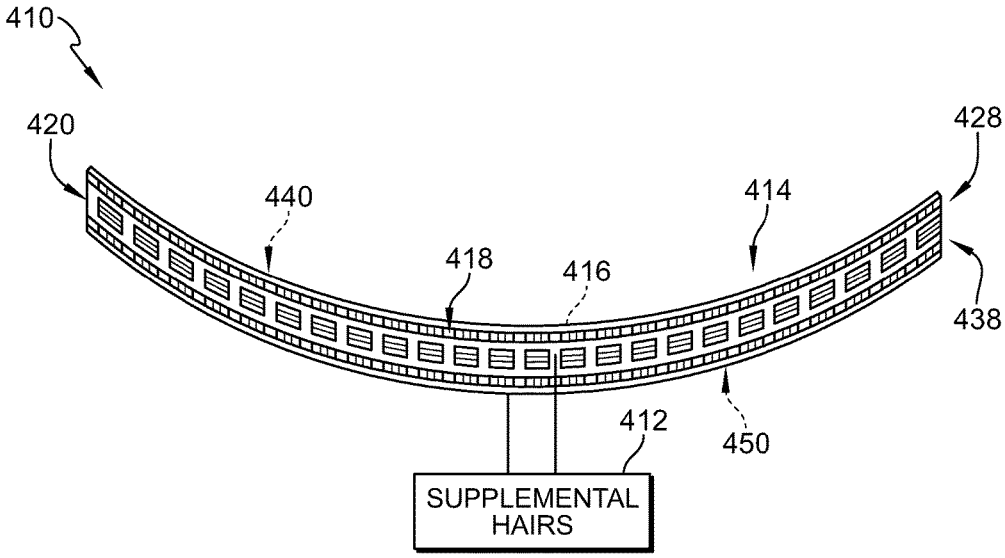

FIG. 11 is a partially-diagrammatic front perspective view of the hair extension of FIGS. 9 and 10 showing that the attachment band includes a connector strip adapted to receive natural hairs from a person, an engagement strip adapted to engage natural hairs received in the connector strip and to lock in a closed position relative to the connector strip, and a tether or elbow that extends from the connector strip to the clamp strip;

FIG. 12 is a partially-diagrammatic rear perspective view of the hair extension of FIGS. 9-11 showing apertures formed in the connector strip to receive teeth formed by the clamp strip as further shown in FIG. 13;

FIG. 13 is a perspective view of the attachment band included in the hair extension of FIGS. 9-12 with the attachment band moved to an open position to show that the guide protrusions that form hair channels included in the connector strip and grip protrusions included in the engagement strip cooperate to provide a hair clamp mechanism for coupling the attachment band to a person's natural hairs when the attachment band is in a closed position, and showing that lock teeth included in the engagement strip cooperate with catches included in the connector strip to provide a band lock mechanism (separate from the hair clamp mechanism) for retaining the attachment band in the closed position;

FIG. 14 is a perspective view of the attachment band included in the hair extension of FIGS. 9-12 with the attachment band moved to the closed position suggesting that a person's hairs are clamped in place by the hair clamp mechanism and that the attachment band is retained in the closed position by the band lock mechanism so that supplemental hairs of the hair extension are removably coupled to the person's natural head of hair;

FIG. 15 is a front elevation view of the attachment band of FIGS. 9-14 with the attachment band in the closed position;

FIG. 16 is a side elevation view of the attachment band of FIGS. 9-15 with the attachment band in the closed position showing the lock teeth of the band lock engaged with the catches of the band lock;

FIG. 17 is a rear elevation view of the attachment band of FIGS. 9-16 with the attachment band in the closed position;

FIG. 18 is a top plan view of the attachment band of FIGS. 9-17 with the attachment band in the closed position;

FIG. 19 is a partially-diagrammatic rear perspective view of a third hair extension design similar to the hair extension of FIGS. 9-12 showing that the attachment band of the third hair extension includes opener tabs configured to aid in release of the band lock to move the attachment band from the closed position to the opened position;

FIG. 20 is a partially-diagrammatic perspective view of a fourth hair extension design similar to the hair extension of FIGS. 9-12 showing that the attachment band of the third hair extension in the opened position and showing that the attachment band is arcuately shaped to conform to the back of a person's head; and FIG. 21 is a partially-diagrammatic perspective view of the fourth hair extension shown in FIG. 19 with the attachment band moved to the closed position.

DETAILED DESCRIPTION

Figure 1:
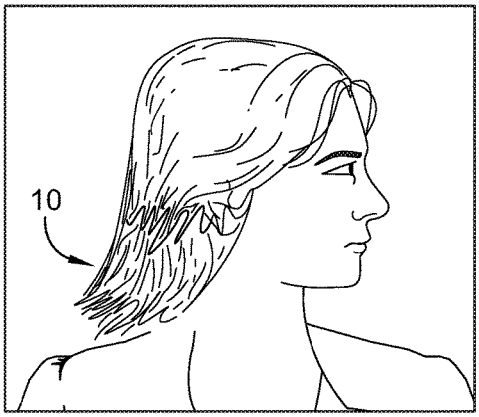
FIG. 1 is a side perspective view of a hair extension integrated into a person's natural head of hair showing supplemental hairs of the hair extension augmenting the person's natural head of hair.

A hair extension 10 according to the present disclosure is adapted to integrated into a person's natural head of hair to add length or fullness to the person's hair as suggested in FIG. 1. The hair extension 10 includes supplemental hairs 12 and an attachment band 14. The supplemental hairs 12 may be natural human hairs, synthetic hairs, or other suitable materials to be integrated into natural hairs for cosmetic reasons. The attachment band 14 is configured to couple the plurality of supplemental hairs 12 to natural hairs mechanically without the use of adhesives.

Figure 2:
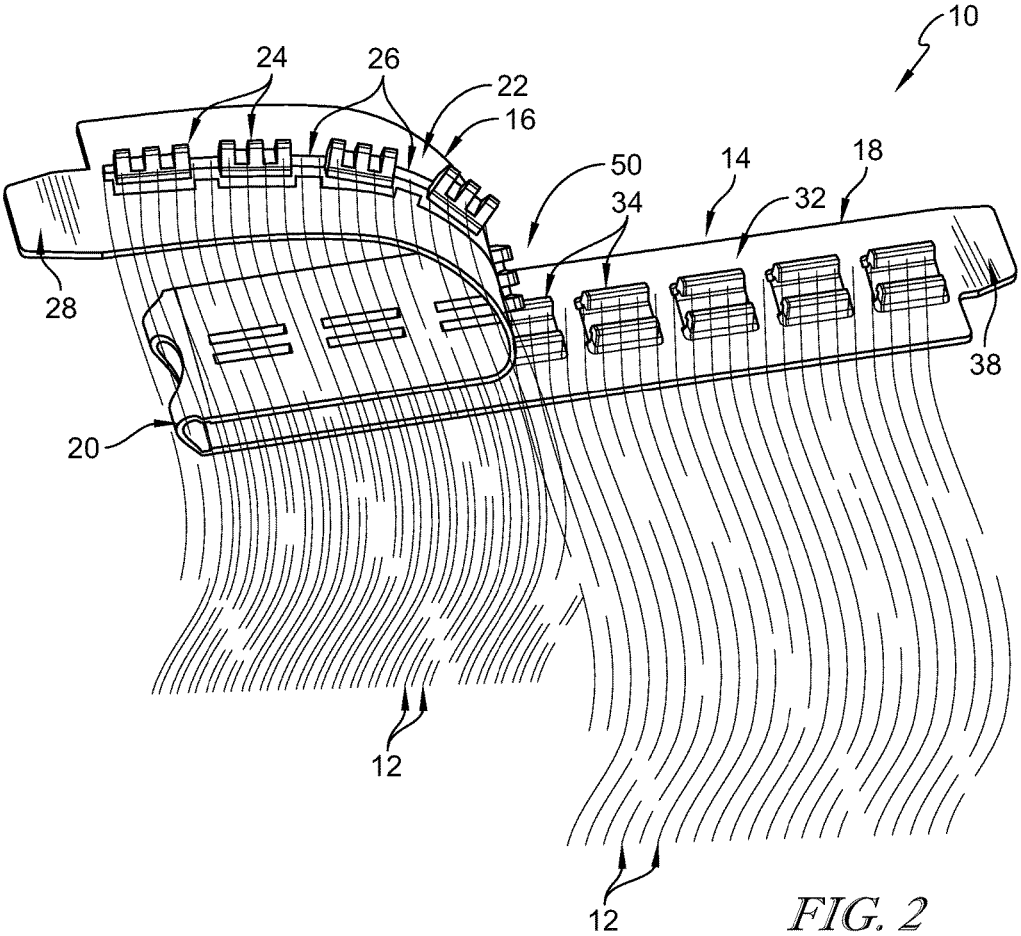
FIG. 2 is a perspective view of the hair extension shown in FIG. 1 showing that the hair extension includes supplemental hairs and a flexible attachment band for coupling the attachment band to hairs in a person's head of hair, the attachment band including fasteners configured to clamp the hairs in the person's head of hair and to retain the attachment band in a closed position.

The attachment band 14 is illustratively flexible so as to conform to the underlying shape of a person's head/hair when coupled to a person's natural hairs as suggested in FIG. 2. The attachment band 14 is a monolithic, one-piece component and is formed to include a connector strip 16, an engagement strip 18, and a tether or elbow 20 interconnecting the strips 16, 18 as shown best in FIG. 3. The attachment band 14 is moved from an opened position (shown in FIG. 3) to a closed position (shown in FIG. 6) by a user sliding a finger along the attachment band 14 while natural hairs are positioned between the connector strip 16 and the engagement strip 18 causing the natural hairs to be clamped in place and the attachment band 14 to be locked in the closed position as suggested in FIG. 2.

Figure 3:
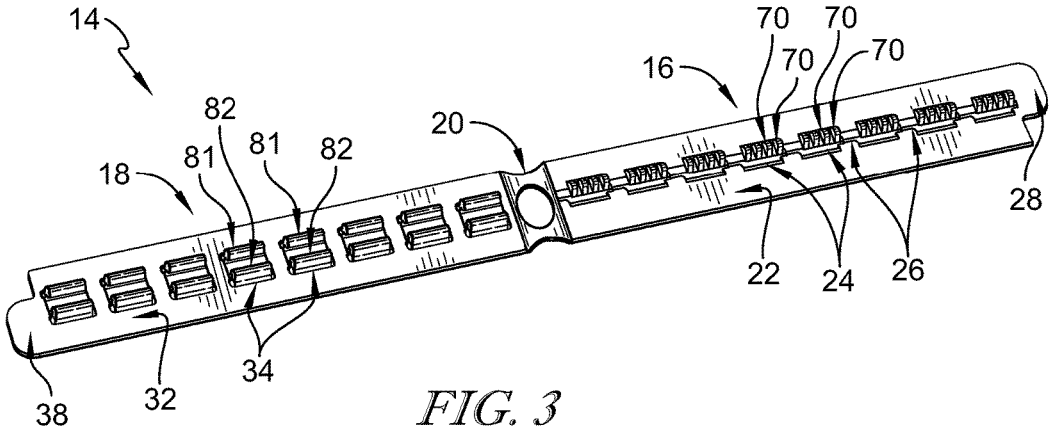
FIG. 3 is a perspective view of the attachment band included in the hair extension of FIGS. 1 and 2 showing that the fasteners of the attachment band are made up of lock teeth and catches.
Figure 5:
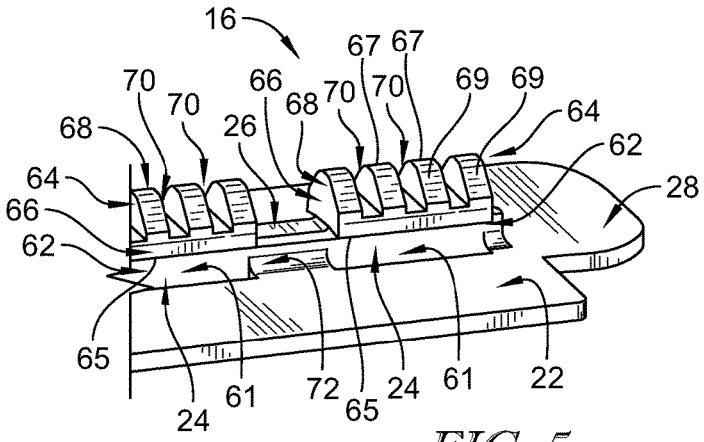
FIG. 5 is a detail perspective view of catches included in the attachment band showing that the catches each include a pair of catch posts arranged to receive and retain a lock tooth therebetween.

The connector strip 16 is designed to be inserted behind a person's natural hair when the attachment band 14 is in the opened position as suggested in FIG. 3. The connector strip 16 includes a connector panel 22, lock teeth 24, reinforcement ribs 26, and a opener tab 28 as shown in FIG. 5. The connector panel 22 is a thin, flexible sheet configured to conform to a person's head/hair. The lock teeth 24 are spaced apart from one another along the connector panel 22 from the tether 20 at one end to the opener tab 28 at the other end. The opener tab 28 extends from the end of the connector panel 22 over only a portion of the height of the connector panel 22 to provide a grip for a user pulling the engagement strip 18 away from connector strip 16 during opening of the attachment band 14.

Figure 4:
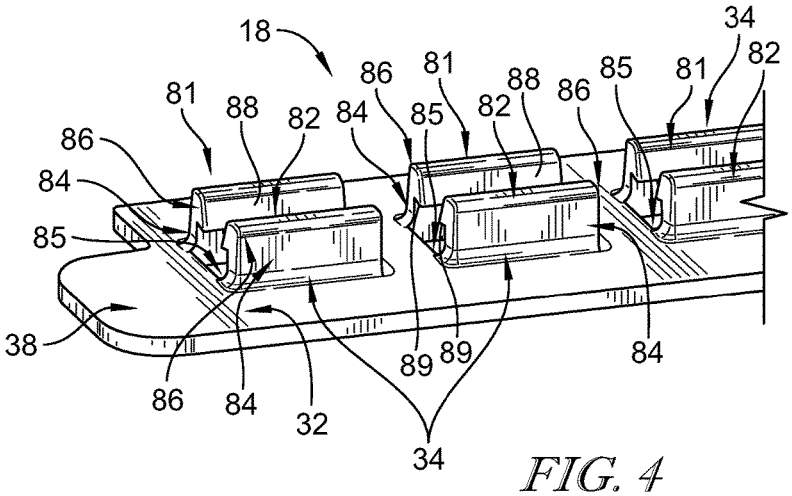
FIG. 4 is a detail perspective view of two lock teeth included in the attachment band showing that each lock tooth is formed to include hair-receiving channels sized to receive hairs from the person's head of hair when the attachment band is coupled to the person's head of hair.

The engagement strip 18 is designed to be laid over and pressed into engagement with the connector strip 16 after a person's natural hair is arranged over the connector strip 16 while the attachment band 14 is in the opened position. The engagement strip 18 includes an engagement panel 32, catches 34, and an opener tab 38 as shown in FIG. 4. The engagement panel 32 is a thin, flexible sheet configured to conform to a person's head/hair. The catches 34 are spaced apart from one another along the engagement panel 32 from the tether 20 at one end to the opener tab 388 at the other end. The opener tab 38 extends from the end of the engagement panel 32 over only a portion of the height of the engagement panel 32 to provide a grip for a user pulling the engagement strip 18 away from connector strip 16 during opening of the attachment band 14.

Figure 6:
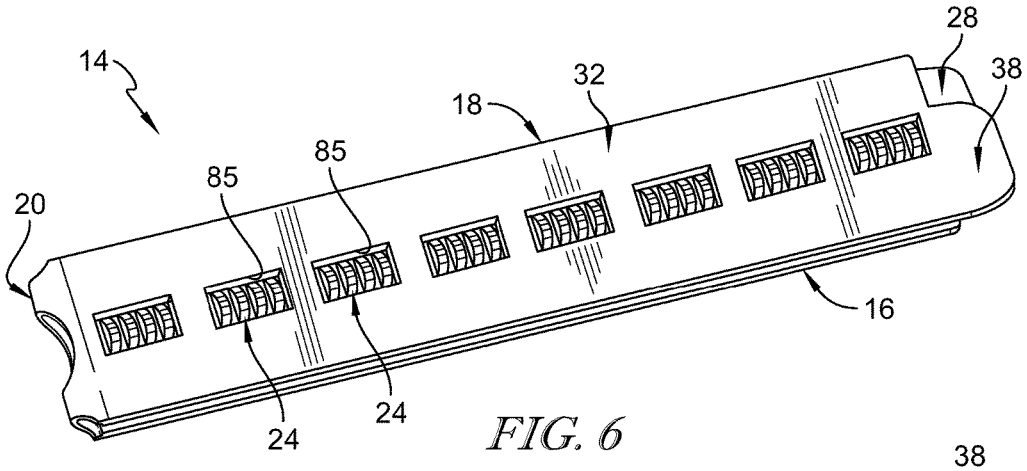
FIG. 6 is a top perspective view of the attachment band of FIGS. 1-5 showing the attachment band in the closed position with the lock teeth received in the catches of the fasteners.
Figure 7:
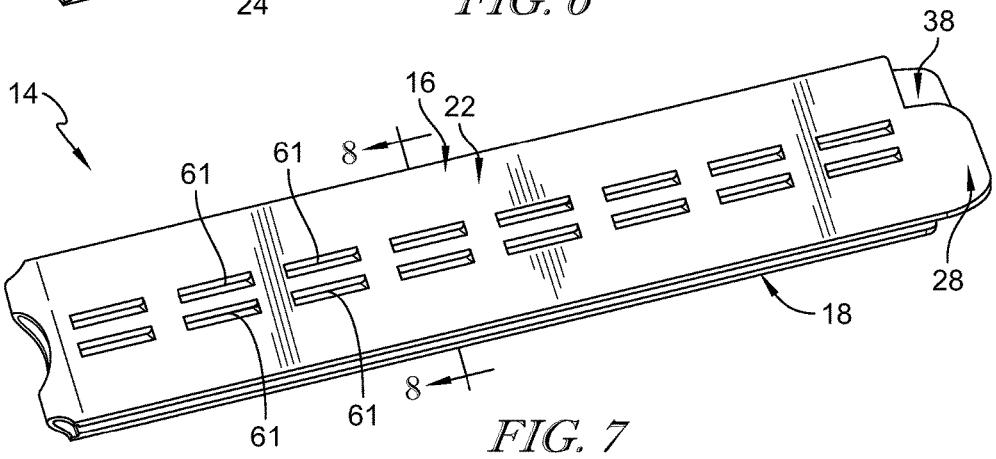
FIG. 7 is a bottom perspective view of the attachment band of FIGS. 1-6 showing the attachment band in the closed position.
Figure 8:
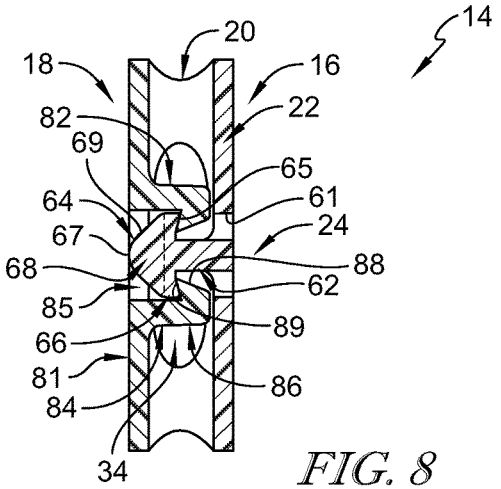
FIG. 8 is a side elevation cross sectional view of the attachment band of FIG. 7 taken along line 8-8 to show a lock tooth engaged by a catch so as to clamp the hairs in the person's head of hair and to retain the attachment band in a closed position.

A band lock mechanism 50 configured to clamps natural hairs and retain the attachment band 14 in the closed position is provided by the lock teeth 24 and the catches 34 as suggested in FIGS. 2, 6, and 8. When the attachment band 14 is in the closed position, the catches 34 are configured to engage natural hairs of a user and the lock teeth 24 to hold the attachment band 14 and the whole hair extension 10 in place relative to the person's natural head of hair.

The lock teeth 24 are illustratively arrow-shaped with stems 62 that extend from the connector panel 22 and caps 64 that extend from the stems 62 to form barbs as shown in FIG. 5. Motion-relief openings 61 are formed in the connector panel 22 adjacent to the stems 62 to allow some movement of the lock teeth 24 relative to the connector panel 22 about a bend axis along the length of the connector panel 22. The caps 64 of each lock tooth 24 include a plate 66 that defines a lock surface 65 extending parallel to an underlying portion of the connector panel 22 and a crown 68 configured to drive movement of catches 34 during movement of the attachment band 14 to the closed position.

The crown 68 of each cap 64 is shaped to have a rounded tip 67 and an angled opener surface 69 as shown in FIG. 5. The rounded tip 67 and angled opener surface 69 cooperate to push catches 34 open during movement of the attachment band 14 to the closed position. The crown 68 of each cap 64 is further formed to include hair receiving channels 70 sized to receive a user's natural hairs and to position the hairs for clamping by the catches 34.

The reinforcement ribs 26 of the connector strip 16 extend between lock teeth 24 to support lock teeth 24 as shown in FIG. 5. The reinforcement ribs 26 illustratively extend from the connector panel 22 and between stems 62 of lock teeth 24. Reinforcement ramps 72 are formed on sides of the reinforcement ribs 26 as they gradually thicken near the connector panel 22.

The catches 34 engage the lock teeth 24 to retain the attachment band 14 in the closed position as shown in FIG. 8. Each catch 34 is made up of two spaced apart posts 81, 82 arranged on opposing sides of apertures 85 formed in the engagement panel 32 as shown in FIG. 4. In the illustrative embodiment, the crown 68 of each cap 64 included in a lock tooth 24 is received in a corresponding aperture 85 between posts 81, 82 of a catch 34 when the attachment band 14 is in the closed position as shown in FIGS. 6 and 8. Each post 81, 82 is a mirror image of the other and includes a neck 84 that extends from the engagement panel 32 and a head 86 that extends from the corresponding neck 84 toward the other post 81, 82.

The head 86 of each post 81, 82 is formed to include an angled cam pivot surface 88. The angled cam pivot surface 88 is shaped to cause the corresponding post 81, 82 to pivot about an unlocking axis along the length of the engagement panel 32 in response to engagement of the surface 88 by angled opener surfaces 69 included in lock teeth 24 during closure of the attachment band 14.

The head 86 of each post 81, 82 is further formed to include a blocker surface 89 extending parallel to an underlying portion of the engagement panel 32. The blocker surfaces 89 are arranged in confronting relation with lock surface 65 of a corresponding lock tooth 24 when the attachment band is in the closed position to block opening of attachment band 14.

Supplemental hairs 12 in the exemplary embodiment are coupled to the connector panel 22 and the engagement panel 32 along a side opposite of lock mechanism 50 components. Supplemental hairs 12 thus remain outside of the space between the connector strip 16 and the engagement strip 18 when the hair extension 10 is coupled to the person's head of hair. In the present disclosure, the terms engagement and connector are used, in general, interchangeably.

In the illustrative embodiment, the flexibility of the attachment band 14 allows for individual elements of the lock mechanism 50 to close in sequence in response to a user sliding a finger along the attachment band 14 while natural hairs are positioned between the connector strip 16 and the engagement strip 18. Accordingly, attachment band 14 provides attachment means for coupling the hair extension 10 to natural hairs of a person's head so that the plurality of supplemental hairs 12 included in the hair extension 10 are removably coupled to the natural hairs.

According to one method of using the disclosed hair extension 10, a user can integrate the hair extension 10 with a natural head of hair and/or remove the hair extension 10 from a natural head of hair. In a step of integrating the hair extension 10, a user may comb or brush up a lifted layer of natural hair under which the hair extension 10 is to be integrated. In another step, the connector strip 16 is inserted behind natural attachment hairs under the lifted layer of hair so that the attachment hairs are arranged in the hair receiving channels 70 of the lock teeth 24. In yet another step, the user may fold the attachment band 14 at the elbow 20 so that the engagement strip 18 overlays the connector strip 16 and attachment hairs with the catches 34 each overlying a corresponding lock tooth 24.

In a further step of the method, the user may slide a finger or fingers along the attachment band 14 from an end at the elbow 20 toward an end at the opener tabs 28, 38 while pressing the engagement strip 18 toward the connector strip 16. This sliding and pressing will cause the engagement strip 18 to flex such that the catches 34 open and then engage natural attachment hairs and lock teeth 24 to clamp the hairs and retain the attachment band 14 in the closed position. In the illustrative embodiment, the flexibility of the engagement strip 18 leads to the engagement of the lock teeth 24 by the catches to happen one at a time as the user slides and presses in a zipper-like manner. The user may then comb the lifted layer of hair down over the attachment band 14 to hide the attachment band 14 within the natural head of hairs.

In a step of removing the hair extension 10, a user may pull the engagement strip 18 by gripping and lifting the opener tab 38 away from the connector strip 16. The user may hold the opener tab 28 of the connector strip 16 in place while pulling the engagement strip 18 so that catches 34 coupled to the engagement panel 32 disengage lock teeth 24 one at a time in order that that attachment hairs in the person's head are unclamped and the connector strip 16 is released for movement relative to the engagement strip 18. The user may then move the hair extension 10 out of the natural head of hair.

A second hair extension 210 according to the present disclosure is adapted to integrated into a person's natural head of hair to add length or fullness to the person's hair as suggested in FIGS. 9 and 10. The hair extension 210 includes supplemental hairs 212 and an attachment band 214. The supplemental hairs 212 may be natural human hairs, synthetic hairs, or other suitable materials to be integrated into natural hairs for cosmetic reasons. The attachment band 214 is configured to couple the plurality of supplemental hairs 212 to natural hairs mechanically without the use of adhesives.

The attachment band 214 is illustratively flexible so as to conform to the underlying shape of a person's head/hair when coupled to a person's natural hairs as suggested in FIGS. 9-14. The attachment band 214 is a monolithic, one-piece component and is formed to include a connector strip 216, an engagement strip 218, and a tether or elbow 220 interconnecting the strips 216, 218 as shown best in FIG. 13. The attachment band 214 is moved from an opened position (shown in FIG. 13) to a closed position (shown in FIG. 14) by a user sliding a finger along the attachment band 214 while natural hairs are positioned between the connector strip 216 and the engagement strip 218 causing the natural hairs to be clamped in place and the attachment band to be locked in the closed position.

The connector strip 216 is designed to be inserted behind a person's natural hair when the attachment band 214 is in the opened position as suggested in FIG. 13. The connector strip 216 includes a connector panel 222, guide protrusions 224, and catches 226 as shown in FIG. 13. The connector panel 222 is a thin, flexible sheet configured to conform to a person's head/hair. The guide protrusions 224 are spaced apart from one another along top and bottom edges of the connector panel 222. The catches 226 are spaced apart from one another along a central portion of the connector panel 222.

The guide protrusions 224 define hair-receiving channels 223 into which a person's natural hair extends when the connector strip 214 is arranged behind the natural hair as suggested in FIG. 13. The hair-receiving channels 223 are located between catches 226 so that a person's hair is not pinched in catches 226 when attachment band 214 is in the closed position.

The engagement strip 218 is designed to be laid over and pressed into engagement with the connector strip 216 after a person's natural hair is arranged in the hair-receiving channels 223 of the connector strip 216 while the attachment band 214 is in the opened position. The engagement strip 218 includes an engagement panel 232, grip protrusions 234, and lock teeth 236 as shown in FIG. 13. The engagement panel 232 is a thin, flexible sheet configured to conform to a person's head/hair. The grip protrusions 234 are spaced apart from one another along (but spaced inwardly from) top and bottom edges of the engagement panel 234. The lock teeth 236 are spaced apart from one another along a central portion of the engagement panel 232.

The lock teeth 236 are illustratively arrow-shaped with top/bottom barbs and are sized/arranged to engage the catches 226 formed by the connector strip 216 as suggested in FIG. 13. The lock teeth 236 further extend through apertures 25 formed in connector panel 222 when the attachment band 214 is moved to the closed position.

Grip protrusions 234 of the engagement strip 218 cooperate with guide protrusions 224 of the connector panel 216 to provide a hair clamp mechanism 240 that clamps a person's hair when the attachment band 214 is moved to the closed position. Natural hair is squeezed by the clamp mechanism 240 to form a mechanical friction coupling between the hair extension 210 and the hair. This coupling can minimize pinching or shearing of the natural hairs.

Lock teeth 236 of the engagement strip 218 cooperate with catches 226 of the connector panel 216 to provide a band lock mechanism 250 that retains the attachment band 214 in the closed position when the attachment band 214 is moved to the closed position. The band lock mechanism 250 generally does not engage natural hairs to avoid pinching or shearing of the hairs.

In the illustrative embodiment, the flexibility of the attachment band 214 allows for individual elements (clamps/locks) of the clamp mechanism 240 and the lock mechanism 250 to close in sequence in response to a user sliding a finger along the attachment band 214 while natural hairs are positioned between the connector strip 216 and the engagement strip 218. Accordingly, attachment band 214 provides attachment means for coupling the hair extension 210 to natural hairs of a person's head so that the plurality of supplemental hairs 212 included in the hair extension 210 are removably coupled to the natural hairs.

A second hair extension 310 is shown in FIG. 19 of the present disclosure. The second hair extension 310 is substantially similar to the second hair extension 210 shown in FIGS. 9-18 and described above. Accordingly, the description of the hair extension 310 is hereby incorporated by reference to apply to the hair extension 310 except as it departs from the further description and drawings of the hair extension 310.

The hair extension 310 differs from the hair extension 210 in that it includes opener tabs 328, 338 configured to allow for opening of the attachment band 314 as suggested in FIG. 19. More specifically, the connector strip 316 includes opener tab 328 that extends from connector panel 322 and the engagement strip 318 includes opener tab 338 that extends from engagement panel 332. Opener tabs 328, 338 have a height of less than the height of the corresponding panel 322, 332 so that the tabs 328, 338 are exposed for gripping by a user removing the hair extension 310.

A fourth hair extension 410 is shown in FIGS. 20 and 21 of the present disclosure. The fourth hair extension 410 is substantially similar to the second hair extension 210 shown in FIGS. 9-18 and described above. Accordingly, the description of the hair extension 210 is hereby incorporated by reference to apply to the hair extension 410 except as it departs from the further description and drawings of the hair extension 410.

The hair extension 410 differs from the hair extension 210 in that attachment band 414 is arcuate shaped when closed to conform to the back of a person's head as shown in FIG. 21. This shape, and other shapes, of the attachment band 414 can allow for the hair extension 410 to be more comfortable for a user.

The hair extension 410 also differs from the hair extension 210 in that it includes opener tabs 428, 438 configured to allow for opening of the attachment band 414 as suggested in FIG. 20. More specifically, the connector strip 416 includes opener tab 428 that extends from connector panel 422 and the engagement strip 418 includes opener tab 438 that extends from engagement panel 432. Opener tabs 428, 438 have a height of less than the height of the corresponding panel 422, 432 so that the tabs 428, 438 are exposed for gripping by a user removing the hair extension 410.

It is contemplated herein that the lock teeth and catches described herein may be modified into singular components. The spaced apart lock teeth described may, in some embodiments, be replaced by a single lock tooth that extends over much (or all) of the length of the attachment band. The spaced apart catches described may, in some embodiments be replaced by a single catch that extends over much (or all) of the length of the attachment band.

The following numbered clauses include embodiments that are contemplated and non-limiting:

Clause 1. A hair extension for integration with a person's head of hair, the hair extension comprising a plurality of supplemental hairs, and an attachment band configured to couple the plurality of supplemental hairs to the person's head of hair, the attachment band including a connector panel, an engagement panel that moves relative to the connector panel from an opened position spaced from the connector panel to a closed position overlaying the connector panel, and a plurality of spaced apart fasteners configured to each clamp hairs in the person's head of hair and to retain the engagement panel in the closed position, wherein each fastener includes a lock tooth coupled to the connector panel and a catch coupled to the engagement panel, the catches of the faster arranged to engage a corresponding lock teeth upon movement of the engagement panel to the closed position, and the engagement panel is flexible such that the catches are configured engage the lock teeth one at a time in response to pressing and sliding of a user's finger along the engagement panel when the engagement panel is arranged over the connector panel.

Clause 2. The hair extension of any other suitable clause, wherein each lock tooth includes a stem that extends from the engagement strip and a cap coupled to the stem and spaced apart from the engagement strip, the cap is configured to be engaged by a corresponding catch included in a fastener when the connector strip is in the closed position, and the cap formed to include at least one hair-receiving channel adapted to receive hairs in the person's head when the attachment band is coupled to the person's head of hair.

Clause 3. The hair extension of any other suitable clause, wherein the fastener includes a plurality of reinforcement ribs that extend from the connector panel and between adjacent lock teeth.

Clause 4. The hair extension of any other suitable clause, wherein the cap of each lock tooth is formed to include a retention panel that extends from the stem and a crown that extends from the retention panel, the retention panel is configured to be engaged by a corresponding catch included in a fastener when the engagement panel is in the closed position, and the crown has an angled opener surface configured to push the a corresponding catch included in a fastener to a disengaged position when the engagement panel is moved to the closed position.

Clause 5. The hair extension of any other suitable clause, wherein the at least one hair-receiving channel formed in each lock tooth extends into a corresponding crown toward the associated retention panel.

Clause 6. The hair extension of any other suitable clause, wherein each catch includes a pair of catch posts spaced apart from one another and configured to engage a corresponding lock tooth included in a fastener when the attachment band is coupled to the person's head of hair.

Clause 7. The hair extension of any other suitable clause, wherein each catch post includes a neck that extends from the connector strip and a head coupled to the neck, the head is shaped to extend from the neck toward an catch post included in the pair of catch posts of a catch, and the head is configured to engage a corresponding lock tooth included in a fastener when the engagement panel is in the closed position to resist movement of the lock tooth away from the catch.

Clause 8. The hair extension of any other suitable clause, wherein the engagement panel is formed to include a plurality of apertures that extend through the engagement panel, each of the plurality of apertures is located between catch posts included in a catch, and each of the plurality of apertures receives a portion of a lock tooth when the engagement panel is in the closed position.

Clause 9. The hair extension of any other suitable clause, wherein each catch post is coupled to the engagement panel to bend from a normally engaged position to a disengaged position, the head of each catch post has an angled surface arranged to be contacted by a lock tooth during movement of the engagement panel to the closed position and shaped to move the associated catch post from the normally engaged position to the disengaged position in response to movement of the engagement panel from the opened position to the closed position.

Clause 10. The hair extension of any other suitable clause, wherein the engagement panel is a flexible strip of material with a thickness equal to the thickness of the connector panel.

Clause 11. A hair extension for integration with a person's head of hair, the hair extension comprising a plurality of supplemental hairs, and an attachment band coupled to the plurality of supplemental hairs, the attachment band including a connector strip, an engagement strip that moves relative to the connector strip from an opened position spaced from the connector strip to a closed position overlaying the engagement strip, and a plurality of spaced apart fasteners that each include a lock tooth and a catch, wherein the catches of the fastener are arranged to engage a corresponding lock tooth upon movement of the engagement strip to the closed position to clamp hairs in the person's head of hair and to retain the engagement strip in the closed position, and wherein the engagement strip is flexible such that the fasteners are engaged one at a time in response to a user sliding a finger along the attachment band so that the attachment band is retained in the closed position.

Clause 12. The hair extension of any other suitable clause, wherein the attachment band is a monolithic one-piece component comprising flexible polymeric materials sized such that the connector strip is flexible enough such that the catches are configured to disengage the lock teeth one at a time in response pulling an end of the connector strip away from a corresponding end of the engagement strip.

Clause 13. The hair extension of any other suitable clause, wherein each lock tooth includes a stem that extends from the engagement strip and a cap coupled to the stem and spaced apart from the engagement strip, and the cap is formed to include at least one hair-receiving channel sized to receive hairs in the person's head when the attachment band is coupled to the person's head of hair.

Clause 14. The hair extension of any other suitable clause, wherein the cap of each lock tooth is formed to include a retention panel that extends from the stem and a crown that extends from the retention panel, and the retention panel is configured to be blocked from removal from a corresponding catch included in a fastener when the engagement strip is in the closed position.

Clause 15. The hair extension of any other suitable clause, wherein the at least one hair-receiving channel formed in each lock tooth extends into a corresponding crown toward the associated retention panel.

Clause 16. The hair extension any other suitable clause, wherein each catch includes a pair of catch posts spaced apart from one another, each catch post includes a neck that extends from a panel included in the engagement strip and a head coupled to the neck, the head is shaped to extend from the neck toward another catch post included in the pair of catch posts of a catch, and the head is configured to retain a corresponding lock tooth in the associated catch when the connector strip is in the closed position.

Clause 17. The hair extension of any other suitable clause, wherein the engagement strip is formed to include a plurality of apertures that extend through the engagement strip, each of the plurality of apertures is located between catch posts included in a catch, and each of the plurality of apertures receives a portion of a lock tooth when the engagement strip is in the closed position.

Clause 18. The hair extension of any other suitable clause, wherein each catch post is coupled to the panel to bend from a normally engaged position to a disengaged position, the head of each catch post has an angled surface arranged to be contacted by a lock tooth during movement of the engagement strip to the closed position and shaped to move the associated catch post from the normally engaged position to the disengaged position in response to movement of the engagement strip from the opened position to the closed position.

Clause 19. A method of using a hair extension, the method comprising laying hairs from a person's head of hair over a connector panel included in an attachment band of the hair extension so that some of the hairs from the person's head are received in hair-receiving channels formed in lock teeth that extend from the connector panel, arranging an engagement panel included in the attachment band of the hair extension to overlay the connector panel so that the hairs from the person's head of hair are located between the connector panel and the engagement panel, and pushing spaced apart catches coupled to the engagement panel into engagement with corresponding lock teeth to engage the lock teeth such that hairs in the person's head are clamped and the engagement panel is retained in place relative to the connector panel.

Clause 20. The method of any other suitable clause, wherein the engagement panel is flexible and the method includes pulling the engagement panel so that catches coupled to the engagement panel disengage lock teeth one at a time in order that hairs in the person's head are unclamped and the engagement panel is released for movement relative to the connector panel.

Although certain illustrative embodiments have been described in detail above, variations and modifications exist within the scope and spirit of this disclosure as described and as defined in the following claims.

The invention claimed is:

1. A hair extension for integration with a person's head of hair, the hair extension comprising a plurality of supplemental hairs, and an attachment band configured to couple the plurality of supplemental hairs to the person's head of hair, the attachment band including a connector panel, an engagement panel that moves relative to the connector panel from an opened position spaced from the connector panel to a closed position overlaying the connector panel, and a plurality of spaced apart fasteners configured to each clamp hairs in the person's head of hair and to retain the engagement panel in the closed position, wherein each of the plurality of fasteners includes a lock tooth coupled to the connector panel and a catch coupled to the engagement panel, each catch of the fastener is arranged to engage a corresponding lock tooth upon movement of the engagement panel to the closed position, and the engagement panel is flexible such that each catch is configured to engage the corresponding lock tooth one at a time in response to pressing and sliding of a user's finger along the engagement panel when the engagement panel is arranged over the connector panel, and wherein the lock tooth includes a stem that extends from the connector panel and a cap spaced apart from the connector panel, the cap is configured to be engaged by a corresponding catch included in the fastener when the engagement panel is in the closed position, the cap is formed to include a plurality of hair-receiving channels that open to face away from the connector panel and that are spaced apart from the connector panel by at least a portion of the stem, and each hair-receiving channel is adapted to receive the natural hairs in the person's head when the attachment band is coupled to the person's head of hair.

2. The hair extension of claim 1, wherein the fastener includes a plurality of reinforcement ribs that extend from the connector panel and between adjacent lock teeth.

3. The hair extension of claim 1, wherein the lock tooth is formed to include a retention panel that extends from the stem and a crown that extends from the retention panel, the retention panel is engaged by the corresponding catch included in the fastener when the engagement panel is in the closed position, and the crown has an angled opener surface configured to push the a corresponding catch included in a fastener to a disengaged position when the engagement panel is moved to the closed position.

4. The hair extension of claim 3, wherein the at least one hair-receiving channel formed in the lock tooth extends into the crown toward the associated retention panel.

5. The hair extension of claim 1, wherein each catch includes a pair of catch posts spaced apart from one another and configured to engage a corresponding lock tooth included in a fastener when the attachment band is coupled to the person's head of hair.

6. The hair extension of claim 5, wherein each catch post includes a neck that extends from the engagement panel and a head coupled to the neck, the head is shaped to extend from the neck toward the catch post included in the pair of catch posts of the catch, and the head is configured to engage the corresponding lock tooth included in the fastener when the engagement panel is in the closed position to resist movement of the lock tooth away from the catch.

7. The hair extension of claim 6, wherein each catch post is coupled to the engagement panel to bend from a normally engaged position to a disengaged position, the head of each catch post has an angled surface arranged to be contacted by the lock tooth during movement of the engagement panel to the closed position and shaped to move the associated catch post from the normally engaged position to the disengaged position in response to movement of the engagement panel from the opened position to the closed position.

8. The hair extension of claim 1, wherein the engagement panel is a flexible strip of material with a thickness equal to the thickness of the connector panel.

9. A hair extension for integration with a person's head of hair, the hair extension comprising a plurality of supplemental hairs, and an attachment band coupled to the plurality of supplemental hairs, the attachment band including a connector strip, an engagement strip that moves relative to the connector strip from an opened position spaced from the connector strip to a closed position overlaying the engagement strip, and a plurality of spaced apart fasteners that each include a lock tooth and a catch, wherein the catch is arranged to engage a corresponding lock tooth upon movement of the engagement strip to the closed position to clamp hairs in the person's head of hair and to retain the engagement strip in the closed position, and wherein the engagement strip is flexible such that the fasteners are engaged one at a time in response to a user sliding a finger along the attachment band so that the attachment band is retained in the closed position, wherein the connector strip includes connector panel and the lock tooth of each fastener, the lock tooth is shaped to include a stem that extends from the connector panel and a cap coupled to the stem at a location spaced apart from the connector panel, and the cap of the lock tooth is formed to include at least one hair-receiving channel defined on at least two sides by the cap and sized to receive hairs in the person's head of hair.

10. The hair extension of claim 9, wherein the attachment band is a monolithic one-piece component comprising flexible polymeric materials sized such that the connector strip is flexible enough such that the catches are configured to disengage the lock teeth one at a time in response pulling an end of the connector strip away from a corresponding end of the engagement strip.

11. The hair extension of claim 9, wherein the cap of the lock tooth included in each of the fasteners is formed to include a retention panel that extends from the stem and a crown that extends from the retention panel, and the retention panel is configured to be blocked from removal from the corresponding catch included in a fastener when the engagement strip is in the closed position.

12. The hair extension of claim 11, wherein the at least one hair-receiving channel formed in each the lock tooth extends into a corresponding crown toward the associated retention panel.

13. The hair extension of claim 9, wherein each catch includes a pair of catch posts spaced apart from one another, each catch post includes a neck that extends from an engagement panel included in the engagement strip and a head coupled to the neck, the head is shaped to extend from the neck toward another catch post included in the pair of catch posts of the catch, and the head is configured to retain the corresponding lock tooth in the associated catch when the engagement strip is in the closed position.

14. The hair extension of claim 13, wherein each catch post is coupled to the engagement panel to bend from a normally engaged position to a disengaged position, the head of each catch post has an angled surface arranged to be contacted by the lock tooth during movement of the engagement strip to the closed position and shaped to move the associated catch post from the normally engaged position to the disengaged position in response to movement of the engagement strip from the opened position to the closed position.

15. A hair extension for integration with a person's head of hair, the hair extension comprising a plurality of supplemental hairs, and an attachment band coupled to the plurality of supplemental hairs, the attachment band including a connector strip, an engagement strip that moves relative to the connector strip from an opened position spaced from the connector strip to a closed position overlaying the engagement strip, and a plurality of spaced apart fasteners that each include a lock tooth and a catch, wherein the catch is arranged to engage a corresponding lock tooth upon movement of the engagement strip to the closed position to clamp hairs in the person's head of hair and to retain the engagement strip in the closed position, and wherein the engagement strip is flexible such that the fasteners are engaged one at a time in response to a user sliding a finger along the attachment band so that the attachment band is retained in the closed position, wherein each catch includes catch posts spaced apart from one another, each catch post includes a neck that extends from an engagement panel included in the engagement strip and a head coupled to the neck, the head is shaped to extend from the neck toward another catch post, and the head is configured to retain the corresponding lock tooth in the associated catch when the engagement strip is in the closed position, and wherein the engagement strip is formed to include a plurality of apertures that extend through the engagement strip, and each of the plurality of apertures is located between the catch posts included in the catch.

16. The hair extension of claim 15, wherein the connector strip includes a connector panel and the lock tooth of each fastener, the lock tooth is shaped to include a stem that extends from the engagement panel and a cap coupled to the stem at a location spaced apart from the engagement panel, and the cap of the lock tooth is formed to include at least one hair-receiving channel defined on at least two sides by the cap and sized to receive hairs in the person's head when hairs in the person's head are clamped.

17. The hair extension of claim 16, wherein each of the plurality of apertures receives a portion of a lock tooth when the engagement strip is in the closed position.

18. A hair extension for integration with a person's head of hair, the hair extension comprising a plurality of supplemental hairs, and an attachment band configured to couple the plurality of supplemental hairs to the person's head of hair, the attachment band including a connector panel, an engagement panel that moves relative to the connector panel from an opened position spaced from the connector panel to a closed position overlaying the connector panel, and a plurality of spaced apart fasteners configured to each clamp hairs in the person's head of hair and to retain the engagement panel in the closed position, wherein each of the plurality of fasteners includes a lock tooth coupled to the connector panel and a catch coupled to the engagement panel, each catch of the fastener is arranged to engage a corresponding lock tooth upon movement of the engagement panel to the closed position, and the engagement panel is flexible such that each catch is configured to engage the corresponding lock tooth one at a time in response to pressing and sliding of a user's finger along the engagement panel when the engagement panel is arranged over the connector panel, wherein each catch includes a pair of catch posts spaced apart from one another and configured to engage the corresponding lock tooth included in a fastener when the attachment band is coupled to the person's head of hair, wherein each catch post includes a neck that extends from the engagement panel and a head coupled to the neck, the head is shaped to extend from the neck toward the catch post included in the pair of catch posts of the catch, and the head is configured to engage the corresponding lock tooth included in the fastener when the engagement panel is in the closed position to resist movement of the lock tooth away from the catch, and wherein the engagement panel is formed to include a plurality of apertures that extend through the engagement panel, each of the plurality of apertures is located between catch posts included in the catch, and each of the plurality of apertures receives a portion of a lock tooth when the engagement panel is in the closed position.

19. A method of using a hair extension, the method comprising laying hairs from a person's head of hair over a connector panel included in an attachment band of the hair extension so that some of the hairs from the person's head are received in hair-receiving channels formed in lock teeth that extend from the connector panel, wherein each of the lock teeth includes a stem that extends from the connector panel and a cap spaced apart from the connector panel, and wherein the cap is formed to include the hair-receiving channels each defined on at least two sides by the cap, arranging an engagement panel included in the attachment band of the hair extension to overlay the connector panel so that the hairs from the person's head of hair are located between the connector panel and the engagement panel, and pushing spaced apart catches coupled to the engagement panel into engagement with corresponding lock teeth to engage the lock teeth such that hairs in the person's head are clamped and the engagement panel is retained in place relative to the connector panel.

20. The method of claim 19, wherein the engagement panel is flexible and the method includes pulling the engagement panel so that catches coupled to the engagement panel disengage lock teeth one at a time in order that hairs in the person's head are unclamped and the engagement panel is released for movement relative to the connector panel.

* * * * *